US005145332A

United States Patent [19]

Bohon

[11] Patent Number: 5,145,332

[45] Date of Patent: Sep. 8, 1992

[54] WELL PUMPING

[75] Inventor: William M. Bohon, Frisco, Tex.

[73] Assignee: Atlantic Richfield Company, Los Angeles, Calif.

[21] Appl. No.: 662,594

[22] Filed: Mar. 1, 1991

[51] Int. Cl.[5] ..... F04B 9/08; F04B 17/00

[52] U.S. Cl. ..... 417/390; 417/401; 417/403

[58] Field of Search ..... 417/390, 401, 403

[56] References Cited

U.S. PATENT DOCUMENTS

| | | | |
|---|---|---|---|
| 4,234,294 | 11/1980 | Jensen | 417/390 |
| 4,347,049 | 8/1982 | Anderson | 417/403 |
| 4,492,536 | 1/1985 | Gilbertson | 417/401 |
| 4,515,516 | 5/1985 | Perrine et al. | 417/390 |
| 4,616,981 | 10/1986 | Simmons et al. | 417/390 |
| 4,761,120 | 8/1988 | Mayer et al. | 417/403 |
| 4,768,420 | 9/1988 | Korthaus | 417/390 |

OTHER PUBLICATIONS

World Oil, May, 1989, What's New in Artificial Life, by J. F. Lea and H. W. Winkler, pp. 30 and 31.

Primer of Oil and Gas Production, American Petroleum Institute, Dallas, Tex., 1962, pp. 24 and 25.

*Primary Examiner*—Richard A. Bertsch
*Assistant Examiner*—Alfred Basichas
*Attorney, Agent, or Firm*—Roderick W. MacDonald

[57] ABSTRACT

Apparatus and method for pumping fluid from a wellbore using a reciprocating downhole pump, the downhole pump being reciprocated by a pumping unit which employs a hydraulic power cylinder means, the power cylinder being actuated with a variable displacement hydraulic pump.

13 Claims, 3 Drawing Sheets

WELL PUMPING

BACKGROUND OF THE INVENTION

The most common means of artificial lift of fluid from a wellbore such as, but limited to, oil and gas wells, is a sucker rod supported downhole reciprocating pump driven by a beam pumping unit, such as illustrated in FIG. 1. A conventional beam pumping unit uses an arrangement of high-torque gears, cranks, levers, and linkages to convert the rotary motion of a drive motor into the reciprocating motion needed to operate the downhole pump. These moving components, especially the high-torque gears, contribute significantly to the capital cost of this type of unit. This arrangement of gears, cranks, and levers also produces a load (torque) of the drive motor that varies widely throughout the pumping cycle. This reduces pumping efficiency because the drive motor operates at less than full-load during most of the pumping cycle.

Many variations and alternatives to beam pumping units have been developed in an attempt to reduce equipment capital costs and at the same time increase pumping efficiency. One such effort was directed to hydraulic powered pumping units wherein the reciprocating motion needed to operate the downhole pump is obtained from an upstanding hydraulic power cylinder which contains a piston whose shaft is connected to a sucker rod string. Samples of such equipment are fully and completely disclosed in "Primer of Oil and Gas Production", published by the American Petroleum Institute, Dallas, Tex., 1962, pages 24 and 25, and "What's New in Artificial Lift", World Oil, May 1989, pages 30 and 31. Current commercially available hydraulic pumping units employ a power cylinder as aforesaid coupled with a compressed gas assist (booster) for the power cylinder as will be disclosed in greater detail hereinafter with reference to FIGS. 2 and 3. The use of hydraulics in lieu of gears, cranks, and the like gives these pumping units a lower capital cost than beam pumping units. For example, compressed nitrogen boosted hydraulic pumping units are available at about 70% of the cost of an equivalent mechanical unit. The elimination of gears, cranks, and the like also allows the cyclic variations in drive motor torque to be minimized, thereby allowing the drive motor to run more efficiently. For example, nitrogen boosted hydraulic pumping units may allow up to a 30% reduction in operating costs.

In general, current operation employing compressed gas-boosted hydraulic pumping units employ compressed nitrogen, for example, so that the pressure of the nitrogen is such that the force exerted by the gas is insufficient to lift the load on the upstroke, but more than sufficient to meet the load or energy requirement for the downstroke. Thus, the hydraulic pump used to actuate the piston in the power cylinder is required to work on the upstroke to lift the load and work on the downstroke to overcome the compressed nitrogen spring and further compress the nitrogen for the next upstroke. The pressure of the nitrogen gas in the booster or spring is adjusted so that the work done by the hydraulic pump on the upstroke is approximately the same as the work done by the same pump during the downstroke. This results in a relatively constant torque for the motor driving the hydraulic pump. This in turn allows that drive motor to operate more efficiently.

Two nitrogen boosted hydraulic pumping units that are currently available commercially will be described in greater detail hereinafter in FIGS. 2 and 3. However, it is important to note that both units use fixed displacement hydraulic pumps in association with solenoid-operated valves to control pumping direction. They also use nitrogen boosters in parallel with the hydraulic pump to assist in pumping as will be disclosed hereinafter in greater detail.

Fixed displacement hydraulic pumps are a species of the genus referred to as positive displacement hydraulic pumps, see "Using Industrial Hydraulics", published by Hydraulics and Pneumatics Magazine, Cleveland, Ohio, 2nd Edition, 1984, page 6-5. A fixed displacement hydraulic pump within the positive displacement hydraulic pump genus is a positive displacement design in which the amount of displacement cannot be varied. At a given input RPM this type of pump must deliver hydraulic fluid flow in an amount equivalent to its fixed displacement. A separate species of pump within the positive displacement hydraulic pump genus is the variable displacement pump which is a positive displacement design in which the amount of hydraulic fluid displacement from the pump can be easily changed.

The amount of hydraulic fluid output flow that is delivered by a fixed displacement pump can be changed only by changing the drive speed of the drive motor for that pump. A positive displacement hydraulic pump whose output flow of hydraulic fluid (otherwise referred to as "displacement") can be varied has numerous advantages in the context of downhole well pumping. The displacement can be varied simply through adjustment by manual means or it can be totally automated and interfaced with computerized programming. Another advantage of the variable displacement hydraulic pump is that heat is not generated by moving hydraulic fluid around a circuit when no work is being done by the hydraulic pump. Even when a fixed displacement hydraulic pump is unloaded, energy is converted into heat simply because the hydraulic fluid is in motion. Likewise, during operation, hydraulic fluid must be diverted, restricted, or removed from the system at a high pressure level. Many times, this pressure level is considerably higher than the actual pressure required to do the work during most of the cycle. On the other hand, the variable displacement pump can be made to produce only the hydraulic energy required to do the work. It can also be made to produce this energy only when it is needed to cause the required motion of the load.

In the context of downhole well pumping, the singular reliance by the prior art upon fixed displacement hydraulic pumps gives the result that the power cylinder drives its piston (and the downhole pump) at a constant velocity so that at the end of the piston stroke when the power cylinder reverses the direction of movement of the piston the reversal is very abrupt. This causes high decelerations and accelerations which induces undesired dynamic loads on the sucker rod string that connects the power cylinder piston to the downhole pump. The results are shorter sucker rod life and an increased number of well workovers.

With a variable displacement hydraulic pump the volume of hydraulic fluid output displaced per revolution of the pump can be varied from zero to full flow while the pump is running. With this capability, near the end of the stroke of the power cylinder piston the velocity of the sucker rod string and downhole pump may be slowed in a smooth and controlled fashion. When the sucker rod string has stopped at the end of the stroke it may then be accelerated in the opposite direction in a similarly smooth and controlled manner. This results in greatly reduced dynamic loading of the sucker rod string and other associated equipment which prolongs the life of the pumping unit, sucker rod string, and downhole pump, and reduces the number of well workovers required.

Also, the prior art employs compressed gas boosters so that they operate in parallel with the fixed displacement hydraulic pumps which requires an extra cylinder which is an expensive item of equipment.

SUMMARY OF THE INVENTION

In accordance with this invention downhole well pumping is accomplished using variable displacement hydraulic pumps. In particular, both reversible and nonreversible variable displacement hydraulic pumps are employed within this invention.

Further, in accordance with this invention compressed gas boosters are employed in series with the variable displacement hydraulic pump. This requires an additional solenoid valve but this cost is more than offset by the elimination of a more expensive hydraulic cylinder.

Accordingly, it is an object of this invention to provide downhole pumping with lower capital cost and lower operating cost as compared to pumping beam units. It is another object to provide a more efficient downhole pumping operation with longer sucker rod string and other equipment life and less well workovers when compared to prior art hydraulic pumping units that employ fixed displacement hydraulic pumps and compressed gas boosters in parallel with the hydraulic pump.

It is another object of this invention to provide an new and improved method and apparatus for wellbore downhole pumping.

It is yet another object to provide a new and improved method and apparatus for employing variable displacement hydraulic pumps in downhole well pumping.

It is another object to provide a new and improve method and apparatus for employing compressed gas boosters in combination with variable displacement hydraulic pumps to achieve more efficient and less costly downhole well pumping.

Other aspects, objects and advantages of this invention will be apparent to those skilled in the art from this disclosure and the appended claims.

DETAILED DESCRIPTION

Figure 1:
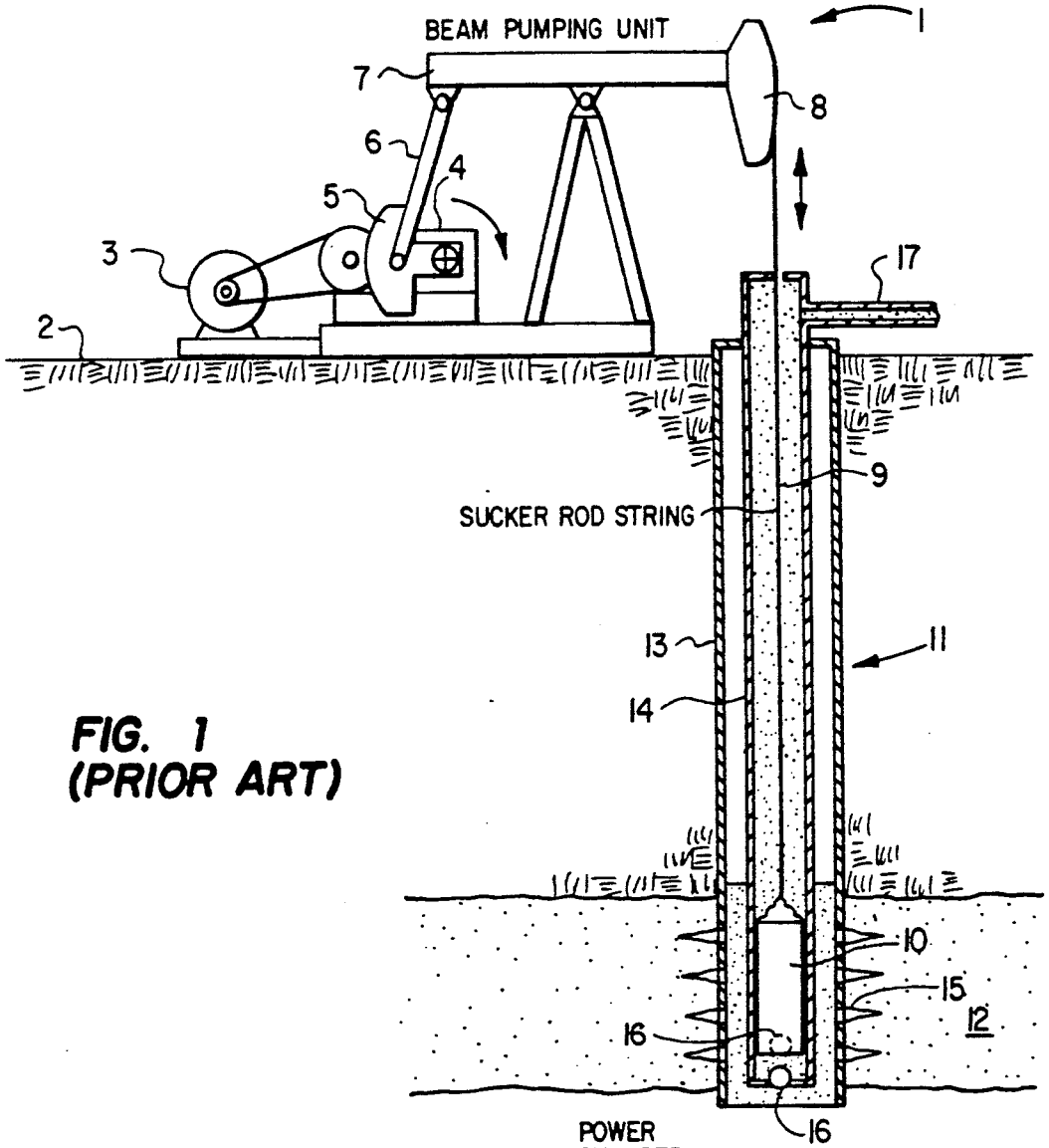
FIG. 1 (PRIOR ART)
FIG. 1 shows a conventional beam pumping unit as employed with a sucker rod string and downhole pump in a wellbore.

FIG. 1 shows a conventional prior art beam pumping unit 1 sitting on the earth's surface 2, the pumping unit being composed of a prime mover 3 which drives gear reducer 4. Gear reducer 4 rotates crank and counterweight 5 which in turn rotates pitman 6. Pitman 6 acts on beam 7 to reciprocate horsehead 8. Horsehead 8 is connected to an elongate sucker rod string 9 which elongate means extends from horsehead 8 down to downhole pump 10 so that reciprocation of sucker rod string 9 also reciprocates and induces the pumping motion desired for downhole pump 10.

Wellbore 11 extends into the earth down to at least subsurface geologic zone 12 from which flows fluids such as oil, water, and the like which are desirably produced to the earth's surface by the action of downhole pump 10. This is achieved by lining wellbore 11 with well casing 13 and then disposing concentric within casing 13 production tubing 14. Pump 10 and sucker rod string 9 are disposed within tubing 14. The reciprocating action of downhole pump 10 brings fluids produced from zone 12 through perforations 15 in casing 13 into the interior of tubing 14 by way of one-way valves 16, and pumps those fluids through tubing 14 to the earth's surface. The fluids are recovered at the earth's surface by way of conduit 17 for treatment, storage, transportation, or other disposition.

As can be seen from FIG. 1 substantial mechanical linkages are employed in beam pumping unit 1 all of which contribute to mechanical inefficiency which, as pointed out hereinabove, is compounded by the fact that the pumping efficiency is reduced because drive motor 3 operates at less than full load during most of the pumping cycle.

Figure 2:
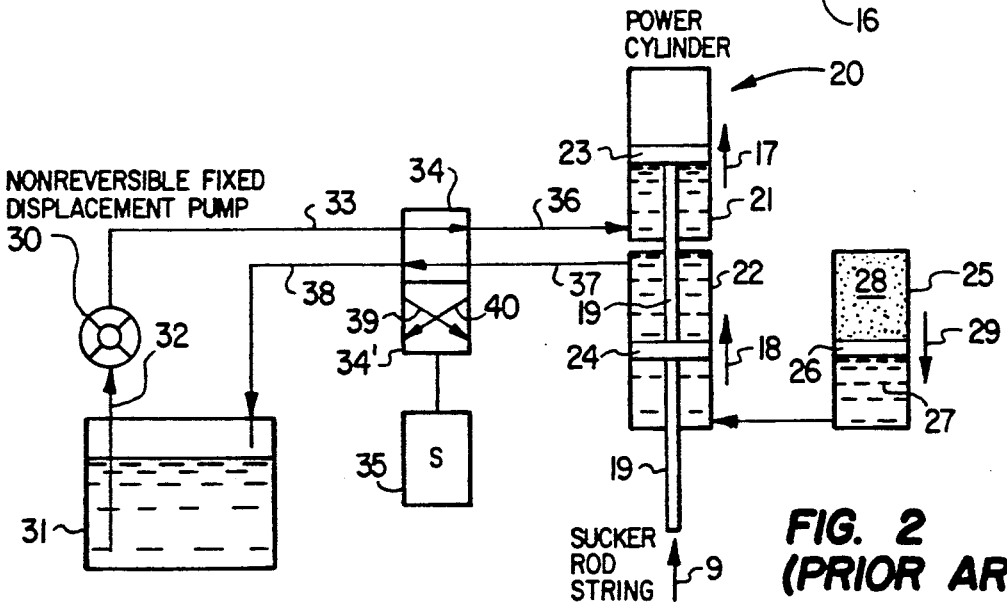
FIG. 2 (PRIOR ART)
FIG. 2 shows a conventional hydraulic pumping unit employing a fixed displacement hydraulic pump for use with the sucker rod string and downhole pump of FIG. 1, and as a replacement for the beam pumping unit of FIG. 1.

FIG. 2 shows a conventional prior art hydraulic pumping unit 20 which is utilized at the earth's surface in place of beam pumping unit 1 of FIG. 1. Pumping unit 20 is composed of dual hydraulic power cylinders 21 and 22 which contain pistons 23 and 24 respectively that are connected together by a common shaft 19 so as to operate in concert. Shaft 19 is connected to sucker rod string 9 so that simultaneous reciprocation of pistons 23 and 24 causes the desired reciprocating downhole pumping action described for FIG. 1.

Connected to lower power cylinder 22, in parallel with hydraulic pump 30, is a compressed gas boost cylinder 25 which contains a piston 26 that separates hydraulic fluid 27 from compressed gas 28, the compressed gas 28 being adjusted in pressure so as to continually force piston 26 downwardly as shown by arrow 29. The drive motor for this hydraulic pumping unit is a nonreversible fixed displacement pump 30 which is connected to a reservoir of hydraulic fluid 31 by means of conduit 32 and whose displacement output of hydraulic fluid is connected by way of conduit 33 to a valve 34 that is operated by solenoid 35. Valve 34 has two positions, one as shown in FIG. 2, connects conduit 33 to conduit 36 and, therefore, to the interior of cylinder 21 below piston 23 and separately connects the interior of cylinder 22 above piston 24 by way of conduits 37 and 38 for the return of hydraulic fluid to reservoir 31. FIG. 2 shows pumping unit 20 in the upstroke mode as indicated by arrows 17 and 18. Accordingly, operation of fixed displacement pump 30 removes hydraulic fluid from reservoir 34, pumps it into the lower portion of cylinder 21 to raise pistons 23 and 24 together and, therefore, sucker rod string 9. At the same time hydraulic fluid is forced from the upper portion of cylinder 22 to reservoir 31 by way of conduits 37 and 38. On the start of the downstroke, solenoid 35 is actuated to move lower valve portion 34' up into alignment with conduits 33, 36, 37 and 38. This way, fixed displacement pump 30, which is nonreversible, then pumps hydraulic fluid from reservoir 31 by way conduits 32 and 33 into conduit 37 as shown by arrow 39 in lower portion 34' so that hydraulic fluid flows instead into the upper portion of the interior of cylinder 22 to force piston 24, and hence piston 23, downwardly for the downstroke action that follows termination of the upstroke. Similarly, in the downstroke mode, hydraulic fluid forced from the interior of cylinder 21 by the downward movement of piston 23 flows into conduit 36 and then into conduit 38, as shown by arrow 40 in lower portion 34', for recovery in reservoir 31.

As can be seen from FIG. 2, the power cylinder consists of two separate cylinders 21 and 22 mounted end to end. Because of this, the stroke length of each piston is only about half the total cylinder length. Thus, a very long power cylinder is required to obtain the desired stroke length. Further, the compressed gas spring 25 is mounted in parallel with hydraulic pump 30 with a consequent need for an extra cylinder and its consequent cost.

Figure 3:
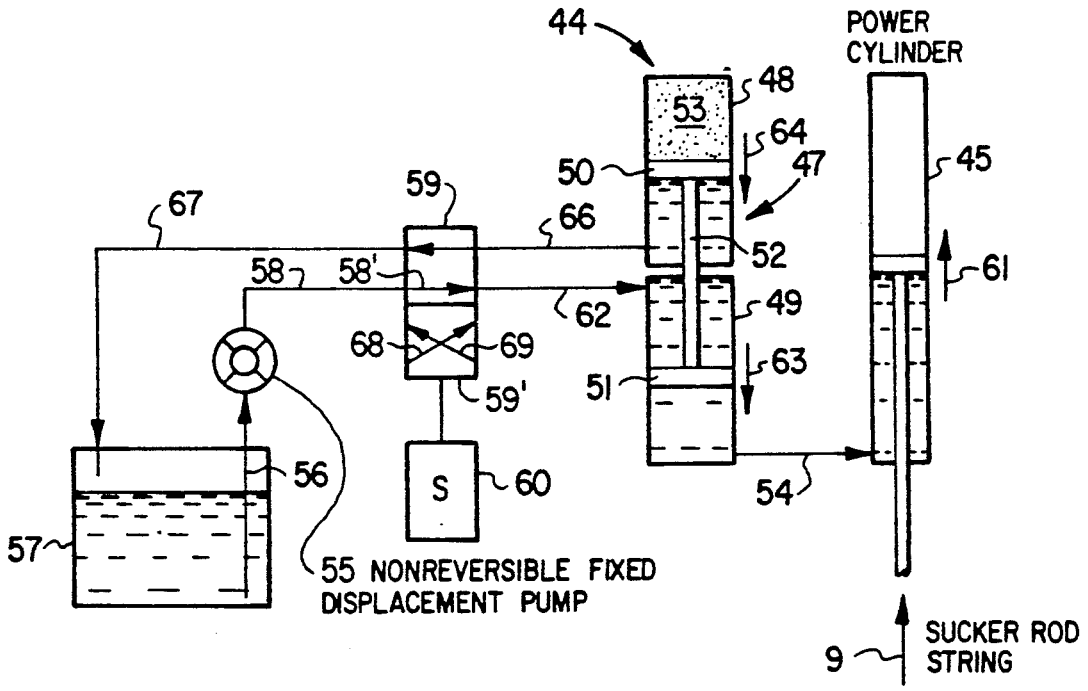
FIG. 3 (PRIOR ART)
FIG. 3 shows another conventional hydraulic pumping unit which also employs a fixed displacement hydraulic pump.

FIG. 3 shows another prior art hydraulic pumping unit 44 which employs a one piece hydraulic power cylinder 45 which contains a piston 46 that is connected to sucker rod string 9. Hydraulic pumping unit 44 carries in parallel to hydraulic pump 55 compressed gas booster or spring 47 which is composed of an upper cylinder 48 and a lower separate cylinder 49 that contain pistons 50 and 51 respectively and that are connected together to operate in concert by common shaft 52. The upper interior of cylinder 48 above piston 50 contains a compressed gas 53 such as nitrogen whereas the remainder of the interior of cylinder 48 below piston 50 and the interior of cylinder 49 both above and below piston 51 contains hydraulic fluid. The lower interior of cylinder 49 below piston 51 is connected to the lower interior of cylinder 45 below piston 46 by conduit 54 so that hydraulic fluid can pass back and forth between cylinders 45 and 49 through conduit 54.

Pumping unit 44 employs a nonreversible fixed displacement hydraulic pump 55. Fixed displacement pump 55 is connected at its inlet, and by way of conduit 56, to a hydraulic fluid reservoir 57. The hydraulic fluid outflow end of fixed displacement pump 55 is connected by way of conduit 58 to a two-stage valve 59 that is operated by solenoid 60. In the upstroke pumping mode, as indicated by arrow 61, conduit 58 is connected by way of valve 59 (arrow 59') to conduit 62 which in turn communicates with the upper interior of cylinder 49 above piston 51 thereby forcing both pistons 50 and 51 downwardly as shown by arrows 63 and 64. This in turn forces hydraulic fluid from the lower portion of cylinder 49 through conduit 54 into the interior of cylinder 45 thereby forcing piston 46 upwardly as shown by arrow 61. Compressed gas 53 works in conjunction with hydraulic fluid in cylinder 49 above piston 51 to force piston 50 downwardly thereby forcing hydraulic fluid below piston 50 out of the interior of cylinder 48 into conduit 66 through valve 59 into conduit 67 for return to the interior reservoir 57. When the upstroke is terminated, solenoid valve 60 moves the lower portion 59' of valve 59 upwardly so that nonreversible pump 55 then pumps hydraulic fluid from conduit 58 into conduit 66 as shown by arrow 68 in valve part 59'. This way hydraulic fluid is pumped into the interior of cylinder 48 below piston 50 thereby to raise both pistons 50 and 51 and further compress gas 53. By moving pistons 50 and 51 upwardly hydraulic fluid is pulled from the interior of cylinder 45 below piston 46 through conduit 54 into the lower portion of cylinder 49 below piston 51 to allow piston 46 to move downwardly. When this occurs hydraulic fluid in cylinder 49 above piston 51 is removed therefrom by way of conduit 62 and transferred to conduit 67 as shown by arrow 69 in valve part 59' for return to reservoir 57.

The hydraulic pumping unit of FIG. 3 avoids the limitations set out above for the hydraulic pumping unit of FIG. 2 in that the stroke length of the single power cylinder 45 of FIG. 3 is approximately the same as the cylinder length, but a pair of double acting cylinders, i.e., elements 48 and 49, are still present, as with elements 21 and 22 of FIG. 2, with their consequent cost.

Figure 4:
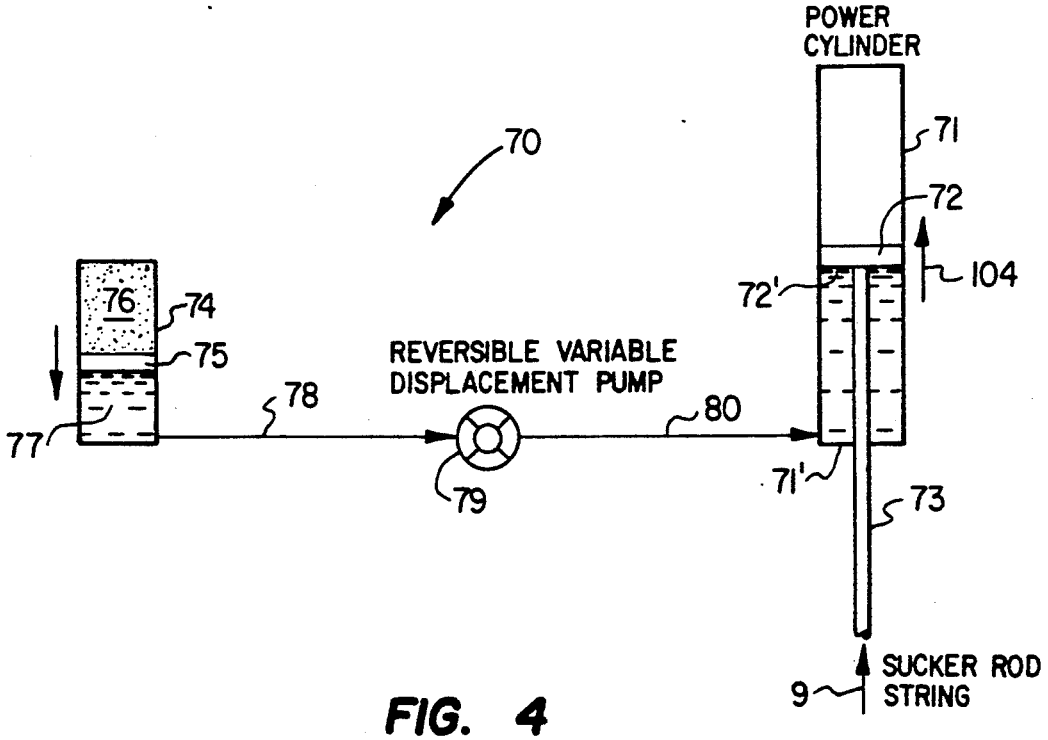
FIG. 4 shows one embodiment of this invention wherein a reversible variable displacement hydraulic pump is employed together with a compressed gas booster in series with that pump.

FIG. 4 shows one embodiment within this invention. This embodiment employs not only a variable displacement pump 79 in contrast to the fixed displacement pumps used exclusively by the prior art, but also a reversible variable displacement pump so that not only are the double acting cylinders of FIGS. 2 and 3 eliminated but also the solenoid valve apparatus. This yields a very simple yet effective hydraulic pumping unit 70 which is composed of a single upstanding hydraulic power cylinder 71 which contains a single piston 72 whose shaft 73 is connected to sucker rod string 9 so that reciprocation of piston 72 yields the desired pumping reciprocation motion for sucker rod string 9 and downhole pump 10 as described hereinabove with reference to FIG. 1. In this embodiment a single hydraulic fluid source 74 is employed which is also a compressed gas booster in that source 74 contains a piston 75 above which is disposed a compressed gas 76, e.g., nitrogen, and below which is disposed hydraulic fluid 77. The term hydraulic as applied to both the apparatus and method of this invention and the operating fluids covered by that apparatus and method is used in the broadest sense to mean the transmission of energy or force by way of a liquid, any liquid that is desired and operable.

The interior of compressed gas booster 74 below piston 75 serves as a hydraulic fluid reservoir and is connected by way of conduit 78 to the inlet side of reversible variable displacement pump 79. The output of pump 79 is directed through conduit 80 to the interior of cylinder 71 below piston 72. Thus, in the upstroke mode as shown in FIG. 4, pump 79 removes hydraulic fluid from the interior of unit 74 and pumps same into the interior of cylinder 71 below piston 72 thereby raising piston 72 as shown by arrow 104. The result is raising sucker rod string 9 and downhole pump 10. Because a reversible variable displacement pump is employed the displacement volume of the pump can be varied during operation of same to create a soft controlled stopping of piston 72 at the end of its cycle and a soft, controlled startup of piston 72 in the reverse direction, thereby imposing much less dynamic load on the apparatus. Further, the direction of hydraulic fluid flow through the pump can be reversed as well, and, most notably, hydraulic fluid flow reversal can occur while pump 79 is running. Accordingly, neither pump 79 nor the electric drive motor (not shown) powering pump 79 need stop nor change direction of rotation.

The embodiment of FIG. 4 has particular application to large, long stroke, high-capacity pumping units. The individual pieces of apparatus shown in FIG. 4 are all commercially available, off-the-shelf equipment supplied by various vendors such as Rexroth Worldwide Hydraulics. The pumps can either be vane type or piston type as desired and available. Accordingly, further detailed description of the apparatus employed is not necessary to inform those skilled in the hydraulics art.

Figure 5:
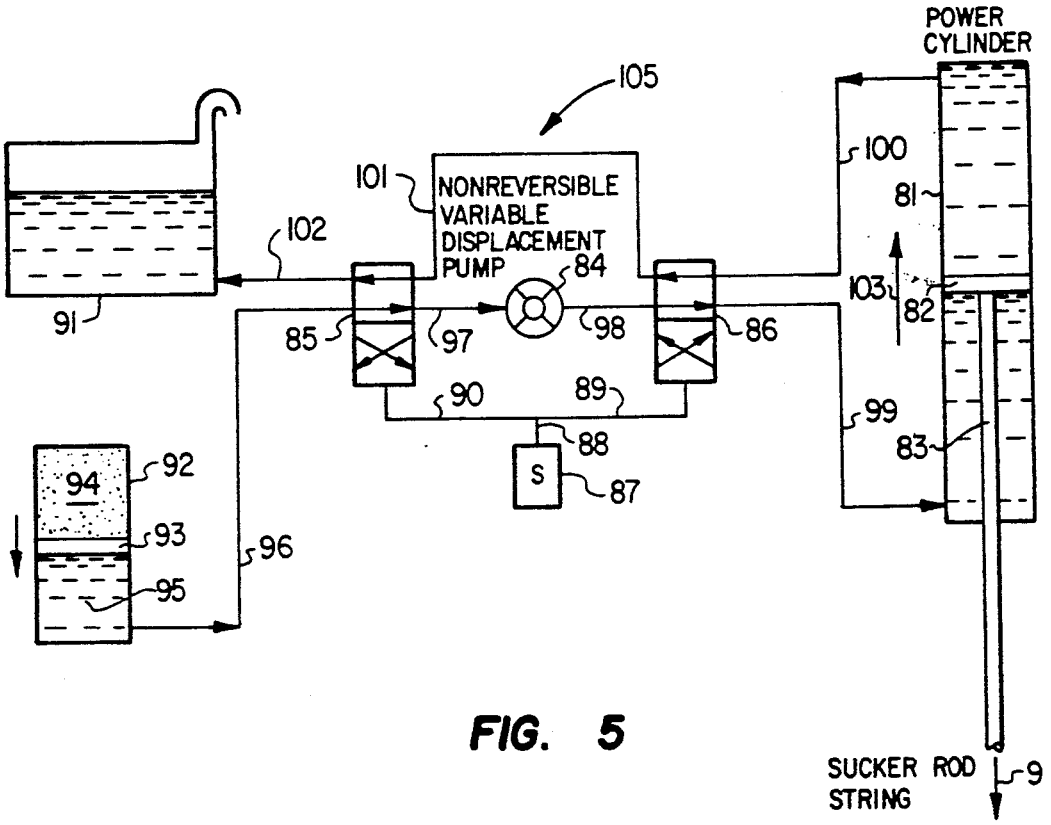
FIG. 5 shows another embodiment within this invention wherein a nonreversible variable displacement hydraulic pump is employed together with a compressed gas booster in series with that pump, FIG. 5 showing the equipment in its upstroke operating mode.

FIG. 5 shows another embodiment within this invention wherein hydraulic pumping unit 105 has a single power cylinder 81 which contains a single piston 82 whose shaft 83 is connected to sucker rod string 9. In contrast to the invention embodiment shown in FIG. 4, this invention embodiment employs a variable displacement pump 84 which is nonreversible. Thus, a pair of valves 85 and 86 are imposed on the inlet and outlet of pump 84, respectively, and operated by solenoid 87 which is connected to both valves 85 and 86 by electrical wires 88, 89, and 90. A hydraulic reservoir 91 is employed together with a compressed gas booster 92 which is connected in series with pump 84 rather than in the parallel configuration of the prior art as shown in FIGS. 2 and 3.

Compressed gas booster 92 contains a piston 93 therein above which is carried the compressed gas 94 and below which is carried hydraulic fluid 95. Conduit 96 connects the lower portion of unit 92 below piston 93 to two-stage valve 85 which in turn is connected by conduit 97 to the inlet of pump 84. The outlet of pump 84 is connected by way of conduit 98 to two-stage valve 86 and then by way of conduit 99 to the interior of power cylinder 81 below piston 82. The interior of power cylinder 81 above piston 82 is connected by way of conduit 100 to valve 86 and then by way of conduit 101 to valve 85 and then by way of conduit 102 to the interior of reservoir 91.

Thus, in the upstroke mode which is shown in FIG. 5 as evidenced by arrow 103, pump 84 removes hydraulic fluid from the interior of compressed gas booster 92 and forces that fluid into the lower interior of power cylinder 81 below piston 82 by the flow of same through conduits 96, 97, 98, and 99. This forces piston 82, shaft 83, sucker rod string 9, and downhole pumps 10 upwardly. This also forces hydraulic fluid in the interior of power cylinder 81 above piston 82 out into conduit 100 through valves 85 and 86 and conduits 101 and 102 into reservoir 91.

Since gas spring 92 is in series with variable displacement pump 84 pumping unit 105 does not have the short-stoke limitation of the pumping unit of FIG. 2 yet uses one less hydraulic cylinder than the pumping unit of FIG. 3. Pumping unit 105 does employ a second solenoid valve as opposed to the pumping units in FIGS. 2 and 3 but this is a beneficial tradeoff because hydraulic cylinders cost more than solenoid valves. As mentioned above, the variable displacement pump can be varied as to the volume of hydraulic fluid displaced per revolution from zero to full flow while the pump is running thereby incurring the advantage that near the end of a stroke, the velocity of the sucker rods may be slowed in a smooth and controlled fashion and when the rods have stopped, the solenoid valves can then be switched to change the direction of movement of the piston and the sucker rods then accelerated in the opposite direction in a similarly smooth and controlled manner, all of which greatly reduces the dynamic loads on the equipment and prolongs the sucker rod string life together with reducing the number of well workovers required.

There are several control strategies that may be employed with apparatus using a variable displacement pump. One control strategy particularly suited to a downhole well pumping application is torque control wherein the displacement of the variable displacement pump is continually adjusted to maintain a constant torque load on the electric motor driving that pump even though the load on, for example, power cylinder 81 may vary. Conventional off-the-shelf electrohydraulics are available for such a control strategy. The microprocessor that controls the system can also act as the pump-off controller. As with the apparatus of FIG. 4, the individual pieces of apparatus necessary to make up pumping unit 105 are commercially available, off-the-shelf equipment available from various vendors. For example, pump 84 can be a Rexroth World Hydraulics industrial variable displacement pump AA4VSG Series 10 while valves 85 and 86 can be Rexroth electrohydraulic 4-way directional servo valve models 4WS2E.10 . . . and 4-WSE2E.10 (series 4X). Thus, further detailed description of the specific apparatus is not necessary to inform those skilled in the hydraulics art.

Figure 6:
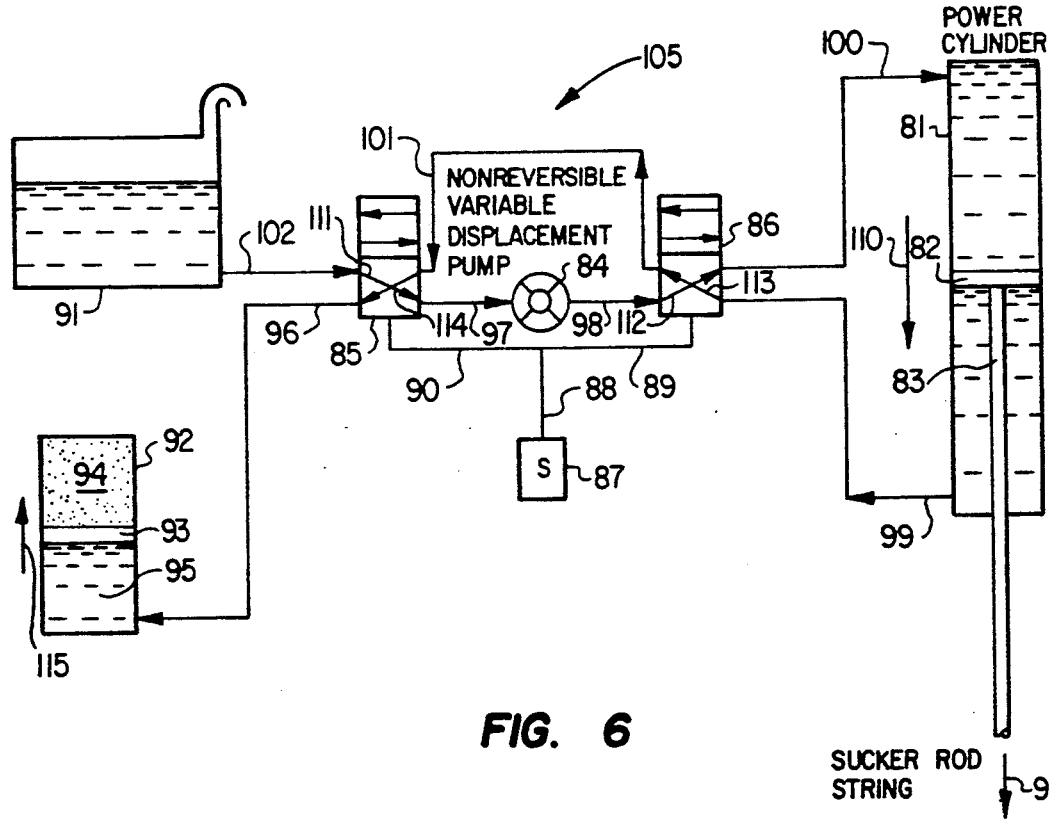
FIG. 6 shows the equipment of FIG. 5 in the downstroke operating mode.

FIG. 6 shows the apparatus of pumping unit 105 of FIG. 5 when that apparatus is in the downstroke mode as indicated by arrow 110. This is accomplished by solenoid 87 actuating valves 85 and 86 to their second stage operating position as shown in FIG. 6. In this position nonreversible variable displacement pump 84 removes hydraulic fluid from reservoir 91 by way of conduit 102 into conduit 97 as shown by arrow 111 which is then displaced as the output of pump 84 into conduit 98 and then into conduit 100 as shown by arrow 112. This way pump 84 forces hydraulic fluid received from reservoir 91 into the upper portion of power cylinder 81 above piston 82 and forces piston 82, sucker rod string 9, and downhole pump 10 downwardly. At the same time hydraulic fluid displaced from the interior of power cylinder 81 below piston 82 into conduit 99 passes into conduit 101 as shown by arrow 113 and then into conduit 96 as shown by arrow 114. The hydraulic fluid in conduit 96 is then forced into the interior of gas spring 92 below piston 93 and piston 93 driven upwardly as shown by arrow 115 against, and to further compress, gas 94.

It can be seen from a comparison of FIGS. 4 and 5 that, with respect to FIG. 4, hydraulic fluid enters and is removed from the same, lower end 71' of power cylinder 71 and operates on the same, lower side 72' of piston 72 when piston 72 is being raised or lowered. In contrast, in the embodiment of FIG. 5 hydraulic fluid can enter either end (upper or lower) of power cylinder 81 on either side of piston 82 and, similarly, can be removed from either end of cylinder 81 and from either side of piston 82. Further, in FIG. 4 there is a single hydraulic fluid supply means whereas in FIG. 5 reservoir 91 represents a first hydraulic fluid supply means while compressed gas booster 92 represents a second hydraulic fluid supply means. Thus, conduits 100, 101, and 102 in combination represent a first conduit means while conduits 96, 97, 98 and 99 represent a second conduit means which second conduit means contains variable displacement pump 84. It is desirable that variable displacement pump 84 be employed in this second conduit means rather than the first conduit means, because the second conduit means is operable in the upstroke mode.

Accordingly, it can be seen from the foregoing that this invention provides a method for pumping a fluid from a lower portion of a borehole to the earth's surface using a reciprocating downhole pump in the borehole by reciprocating the downhole pump with a hydraulic power cylinder and actuating the hydraulic power cylinder to cause the desired reciprocating motion with a variable displacement hydraulic pump, such pump either forcing hydraulic fluid into and out of the same end of the power cylinder means as shown in FIG. 4 or, alternatively, forcing hydraulic fluid alternately into and out of opposing ends of the power cylinder as shown in FIGS. 5 and 6.

Reasonable variations and modifications are possible within the scope of this disclosure without departing from the spirit and scope of this invention.

What is claimed is:

1. In apparatus for pumping a fluid from at least one geologic zone below the earth's surface through a wellbore that extends from at least said geologic zone to the earth's surface using at least one reciprocating downhole pump means in said wellbore, said downhole pump means being carried by elongate means which extends in said wellbore from said downhole pump means to the earth's surface, said downhole pump means and elongate means being reciprocated by a pumping unit located at or near the earth's surface, the improvement comprising at least one hydraulic pump means in said pumping unit to reciprocate said elongate means and downhole pump means in said wellbore, said hydraulic pump means comprising at least one hydraulically actuated power cylinder means having first and second ends and a piston means therein, said piston means having first and second sides and being connected to said elongate means at the opposite end of said elongate means from said downhole pump means, at least one variable displacement hydraulic pump operably connected to said power cylinder means to pump hydraulic fluid into and out of said power cylinder means and move said piston means thereby to reciprocate said elongate means and downhole pump means in said wellbore.

2. The apparatus according to claim 1 wherein said at least one hydraulic pump is a reversible variable displacement pump which pumps hydraulic fluid into and out of the same end of said cylinder means on the same side of said piston means.

3. The apparatus according to claim 2 wherein said reversible variable displacement pump is operably connected to at least one hydraulic fluid supply means from which said pump can pull hydraulic fluid and force same into one end of said cylinder means, and can alternatively pull hydraulic fluid from the same end of said cylinder means and force same back into said supply means.

4. The apparatus according to claim 3 wherein said fluid supply means is connected in series with said reversible variable displacement pump and carries compressed gas means which continually biases said fluid supply means to force hydraulic fluid from said supply means towards said reversible variable displacement pump.

5. The apparatus according to claim 4 wherein said compressed gas means employs nitrogen.

6. The apparatus according to claim 1 wherein said least one hydraulic pump is a nonreversible variable displacement pump employed so as to be capable of pumping hydraulic fluid into either end of said power cylinder means.

7. The apparatus according to claim 6 wherein there is employed a first hydraulic fluid supply means and first conduit means for supplying hydraulic fluid to a first end of said power cylinder means and first side of said piston means, second hydraulic fluid supply means and second conduit means for supplying hydraulic fluid to a second opposing end of said power cylinder means and second opposing side of said piston means, said nonreversible variable displacement pump being operably connected to one of said first or second conduit means, and a pair of solenoid valve means operably connected to both said first and second conduit means on either side of said nonreversible variable displacement pump, said solenoid valve means being arranged to alternate the output of said pump between said first and second ends of said power cylinder means and therefore opposite sides of said piston means thereby to reciprocate all of said piston means, elongate means, and downhole pump means.

8. The apparatus according to claim 7 wherein said power cylinder means is upstanding and said nonreversible variable displacement pump is operably connected to said second conduit means, said second end of said power cylinder means is the lower end of same so that hydraulic fluid admitted at said second end of said power cylinder means forces said piston means upwardly, and said first end of said power cylinder means is the upper end of same so that hydraulic fluid admitted at said first end of said power cylinder means forces said piston means downwardly.

9. The apparatus according to claim 8 wherein said second hydraulic fluid supply means is connected in series with said nonreversible variable displacement pump and carries compressed gas means which continually biases said fluid supply means to force hydraulic fluid therefrom towards said nonreversible variable displacement pump.

10. The apparatus according to claim 9 wherein said compressed gas means employs nitrogen as the gas.

11. In a method for pumping a fluid from a borehole in the earth to the earth's surface wherein a downhole pump is reciprocated in said borehole by use of a pumping unit at or near the earth's surface, the improvement comprising reciprocating said downhole pump with a hydraulic power cylinder means in said pumping unit, and actuating said hydraulic power cylinder means to cause said reciprocating motion with a variable displacement hydraulic pump.

12. The method according to claim 11 wherein said variable displacement hydraulic pump is reversible, and said reciprocating motion is achieved by pumping hydraulic fluid into and out of the same end of said power cylinder means.

13. The method according to claim 11 wherein said variable displacement hydraulic pump is nonreversible, and said reciprocating motion is achieved by alternately pumping hydraulic fluid into and out of opposing ends of said power cylinder means.

* * * * *